US006309243B1

(12) United States Patent
Tu et al.

(10) Patent No.: US 6,309,243 B1
(45) Date of Patent: Oct. 30, 2001

(54) HIGH DENSITY CABLE ASSEMBLY AND GROUNDING PIECES OF CONNECTORS OF THE SAME AND METHOD FOR GROUNDING

(75) Inventors: Ching Liang Tu; Rong-Huei Lin, both of Taipei Hsien (TW)

(73) Assignee: Starlink Electronics Corp., Taipei Hsien (TW)

( * ) Notice: Subject to any disclaimer, the term of this patent is extended or adjusted under 35 U.S.C. 154(b) by 0 days.

(21) Appl. No.: 09/418,129

(22) Filed: Oct. 14, 1999

(51) Int. Cl.[7] ..... H01R 12/24

(52) U.S. Cl. ..... 439/497; 439/101; 439/108; 439/947

(58) Field of Search ..... 439/497, 510, 439/513, 947, 106, 107, 188, 101, 108

(56) References Cited

U.S. PATENT DOCUMENTS 4,260,209 * 4/1981 Zell et al. ..... 339/14
5,967,832 * 10/1999 Ploehn ..... 439/497
6,077,105 * 6/2000 Jochen et al. ..... 439/497
6,120,319 * 9/2000 Lee et al. ..... 439/497

* cited by examiner

*Primary Examiner*—Paula Bradley
*Assistant Examiner*—Truc Nguyen
(74) *Attorney, Agent, or Firm*—Dougherty & Troxell

(57) ABSTRACT

A cable assembly has a flat cable, and a plurality of connectors connected to the flat cable. Each connector includes a plurality of signal terminals, at least one grounding piece and an insulating body. A specific grounding device is formed on a specific position of the grounding piece. The spacing wall of the grounding piece slot and the signal terminal slot of the insulating body with respect to the base of the grounding piece is hollowed so that when the grounding piece is inserted into the grounding piece slot, the specific grounding device passes through the hollow portion to directly contact at least one specific signal terminal in the adjacent signal terminal slot. The signal transferred by the at least one specific signal terminal will ground without passing through the specific conductive wire of the bank wire.

3 Claims, 6 Drawing Sheets

HIGH DENSITY CABLE ASSEMBLY AND GROUNDING PIECES OF CONNECTORS OF THE SAME AND METHOD FOR GROUNDING

FIELD OF THE INVENTION

The present invention relates to a high density cable assembly, and especially to a cable assembly connected to a computer motherboard and other peripheral elements, wherein the grounding way and the grounding piece of the connector in the cable assembly serves to simplify the assembling process of the cable assembly and the cost is reduced greatly.

BACKGROUND OF THE INVENTION

In general, the signal transformation structure of a computer motherboard and computer peripheral devices (for example, hard disk drivers and optic disk drivers) is achieved by the matching between a cable (flat cable) and connectors. The matching between the flat cable and connectors are widely used in the technology. In general, a cable assembly is formed by a flat cable and three approximately identical connectors. The three connectors serve to be connected with the terminal connectors of for example a motherboard, a hard disk driver, and an optic disk driver so that the signals in the three active devices may be communicate d through the flat cable. Conventionally, the connector matching with this flat cable generally has a positioning cover, an insulating body, terminals (signal terminals and grounding terminals) and others. In assembly, the positioning cover and the insulating body are combined firstly for forming a space, and then the flat cable is inserted into the space. Then, a fixture serves to press the positioning cover downwards so as to be combined with the insulating body. As the positioning cover is pressed downwards, a piercing terminal within the inserting hole of the insulating body terminal will pierce the insulated skin of the flat cable so as to contact with the central wire of the conductor within the flat cable. In some prior art, in order to avoid the flat cable contacting with the terminal is pulled to form an ill contact. Therefore, a pressing cover is further provided. The function of the pressing cover is that when the flat cable bends upwards from below the positioning cover to above the positioning cover, the pressing cover presses the positioning cover combined with the insulating body for avoiding loosening between the flat cable and the terminals.

The aforesaid flat cable connector has been disclosed in U.S. Pat. Nos. 4,359,257, 5,104,336, 5,417,584, and 5,509,195 and Taiwan Patent Nos. 82200254, 81105296, 86213505, 85218513 and 86214200.

Recently, with the increase of the amount of signal transfer and transferring speed, the flat cable tends to a high density design. Namely, the gaps in the slender lines of the flat cable are reduced and the number of the slender lines are increased. Since the high density of the flat cable, in order to insure that no noise interruption will occur in the process of signal transformations between the three active devices, the signal wires and the grounding wires are arranged alternatively for being connected to the signal terminals and the grounding terminals, respectively. In some applications, some specific signal wires of the flat cable must be further connected to the grounding terminals for filtering noises. In some cases, one specific signal wire must be connected to the grounding terminal (for example first connector connected to the motherboard) in the cable assembly but not electrically connected to any connector (for example the second connector and third connector for being connected respectively to a hard disk driver and an optic disk driver) of the cable assembly. In other words, the specific signal wire must be connected with the grounding piece of the first connector, and signals will be transferred between the second connector and the third connector but not transferred to the first connector.

For the aforesaid special case, a specific conductive wire is connected to the signal terminal and grounding terminal of the first connector and then a small notch is formed in the signal wire (i.e. forming an open circuit) so that the portion of the conductive wire after the notch is still in contact with the second connector and third connector, but not conductively connected with the first connector.

However, in the prior art for the special case, the grounding piece of the first connector must have some difference from the second connector and the third connector. Therefore, in manufacturing the grounding piece, at least two grounding piece punching molds are necessary, one for manufacturing the grounding piece having grounding terminal (for first connector) with respect to the No. 34 signal wire, and another for the grounding piece without grounding terminal (for second connector and third connector) with respect to the No. 34 signal wire. This increases cost, and, since the differences between the two grounding pieces are very slight, some improper assembly risks are incurred. Moreover, the notch in the specific signal wire causes difficulty in assembly.

SUMMARY OF THE INVENTION

Accordingly, the primary object of the present invention is to provide a cable assembly, whereby, the plurality of connectors uses identical grounding pieces to reduce cost and the processes of the assembling.

Besides, another object of the present invention is to provide a cable assembly, wherein a guiding positioning device is provided between the grounding piece slot and the grounding piece of the connector insulating body so that the grounding piece is precisely positioned in the slot.

A further object of the present invention is to provide a grounding method for a cable assembly. Thereby, when at least one specific signal wire is not connected to the signal terminal with respect to one specific connector in the cable assembly, by the grounding piece of the connector, signals may be grounded. Therefore, all the grounding pieces in the connectors of the cable assembly are identical.

According to the features of the present invention, a cable assembly is provided, which comprises: a flat cable formed by alternatively arranging a plurality of signal wires and a plurality of grounding wires; and a plurality of connectors connected to the flat cable and arranged at specific positions at and between two ends of the flat cable; comprising: a plurality of signal terminals for being electrically communicated to the signal wires of the flat cable; at least one grounding piece including a base and a plurality of grounding terminals at the base, wherein the grounding terminals are electrically connected to the grounding wires of the flat cable, and at least one specific position of the base is punched grounding device; an insulating body installed with a plurality of signal terminal slots, each slot serving to be inserted the plurality of signal terminals, and at least one grounding piece slot for being inserted by the grounding piece being installed, wherein at the spacing wall of the at least one grounding piece slot and the signal terminal slot, the portion of the specific grounding device with the base of the grounding piece are hollowed so that when the grounding piece is inserted into the slot, by the at least one specific grounding device to pass through the hollow portion so as to contact directly with the at least one specific signal terminal with respect to the adjacent signal terminal slot, the signal transferred by the at least one specific signal terminal will be grounded without passing the through the flat cable; and a positioning cover including a body, a receiving portion for receiving the flat cable being installed at the body, the receiving portion being matched with the insulating body for clamping and fixing the flat cable.

According to the design of the grounding piece in the present invention, the grounding of some specific signal can be achieved by a specific grounding device to contact with the specific signal terminal. Thus, all the connectors of the cable assembly use identical grounding pieces.

According to another feature, a method for grounding a cable assembly is disclosed. The method comprises the steps of: providing a flat cable formed by alternatively arranging a plurality of signal wires and a plurality of grounding wires, providing a connector having an insulating body, and a plurality of terminal slots being installed at the insulating body and at least one grounding piece slot, hollowing at least one specific portion of the spacing walls between the signal terminal slots and the grounding piece slot; inserting a plurality of signal terminals into the signal terminal slots; inserting at least one grounding piece into the grounding piece slot, a specific portion of the grounding piece being punching with at least one specific grounding device so that when the grounding piece is inserted into the slot, the at least one specific grounding device will pass through at least one hollow portion at the spacing walls between the signal terminal slots and the grounding piece slot; and connecting the connector and the flat cable together so that the alternatively arranged signal wires and grounding wires in the flat cable are connected to the signal terminals and grounding terminals of the connector, respectively.

The various objects and advantages of the present invention will be more readily understood from the following detailed description when read in conjunction with the appended drawing.

DETAILED DESCRIPTION OF THE PREFERRED EMBODIMENTS

Figure 1:
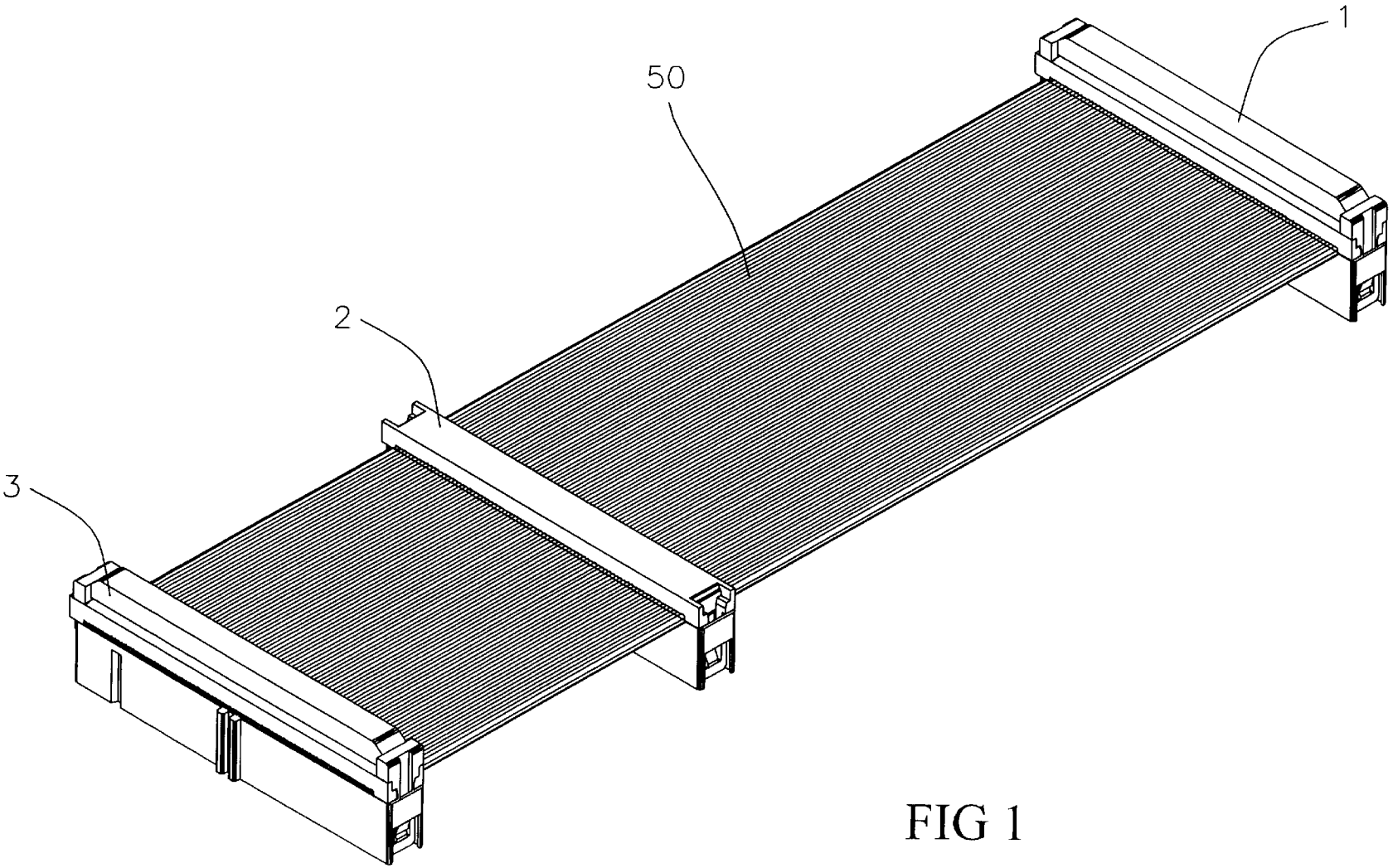
FIG. 1 illustrates a perspective view of the cable assembly according to the present invention.

With reference to FIG. 1, the cable assembly of the present invention includes a flat cable 50 and three connectors 1, 2 and 3 which are positioned at the specific positions at and between two ends of the flat cable 50 and are connected to the terminal connectors (not shown) of three active devices (for example, a motherboard, a hard disk, and an optic disk), respectively. Thus, these active devices can communicate through the flat cable. Since the three connectors have the same structure, only one is described in the following.

Figure 2:
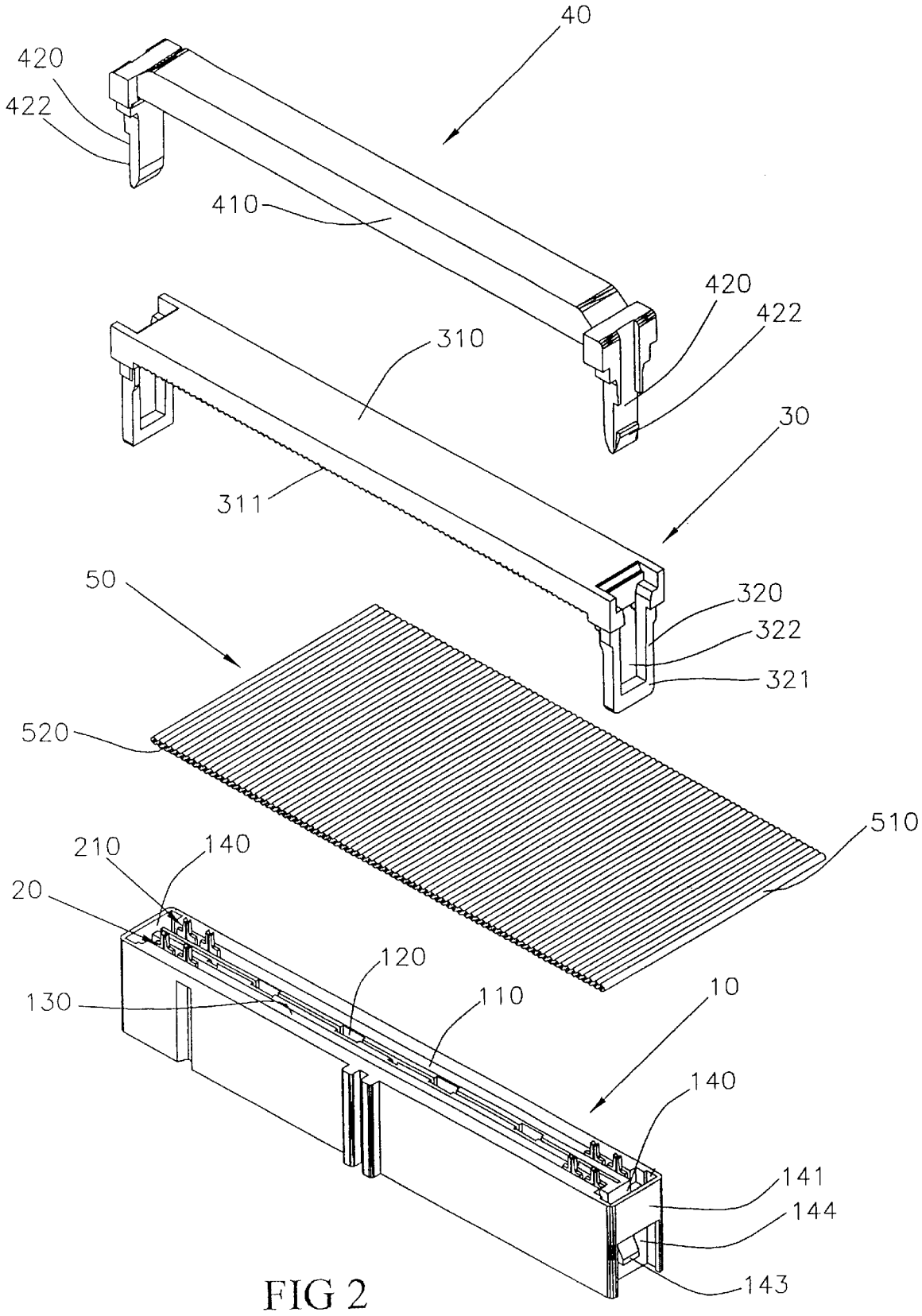
FIG. 2 is an exploded perspective view of the flat cable connectors in the present invention, for clarity, the grounding piece of the connector is not shown.

As shown in FIG. 2, the connector is formed by an insulating body 10, a plurality of signal terminals 20, a positioning cover 30 and a positioning cover 40. The insulating body 10 is formed with three rows of the slots 110, 120 and 130. The slots 110 and 130 accommodate the plurality of signal terminals 20. While the central slot 120 accommodates a grounding piece 25 (referring to FIG. 3). As shown, contact portion 210 of each signal terminal 20 is exposed out of the insulating body 10 for piercing the insulating layer 510 of the flat cable 50 so as to be electrically connected to the central wire 520 of the conductor enclosed.

Each longitudinal end of the insulating body 10 has a receiving through hole 140. The upper portion of the receiving through hole 140 has an outer wall 141. The lower portion of the inner wall 144 is protruded with a buckling flange 143. The positioning cover 30 includes a body 310, and buckling arms 320. The shape of the buckling arm is an approximate hollow oblong body. The positioning cover body 310 serves to clamp the flat cable 50. Moreover, when the buckling arm 320 inserts into the receiving through hole 140 of the insulating body 10, the lower edge 321 of the buckling arm 320 will buckle with the buckling flange 143 of the receiving through hole 140. Besides, the central hollow portion 322 of the buckling arm 320 serves to provide a buckling space for the pressing cover 40 and the insulating body 10. As shown in the figure, the pressing cover 40 includes a body 410 and two hook arms 420 extending from the two ends of the body 410. A hook portion 422 protrudes form the distal end of the hook arm 420. When the hook arm 420 passes through the central hollow portion 322 of the buckling arm 320, the hook portion 422 will elastically match with the outer wall 141 of the receiving through hole 140 so that the pressing cover 40 is tightly engaged with the insulating body 10.

Figure 3:
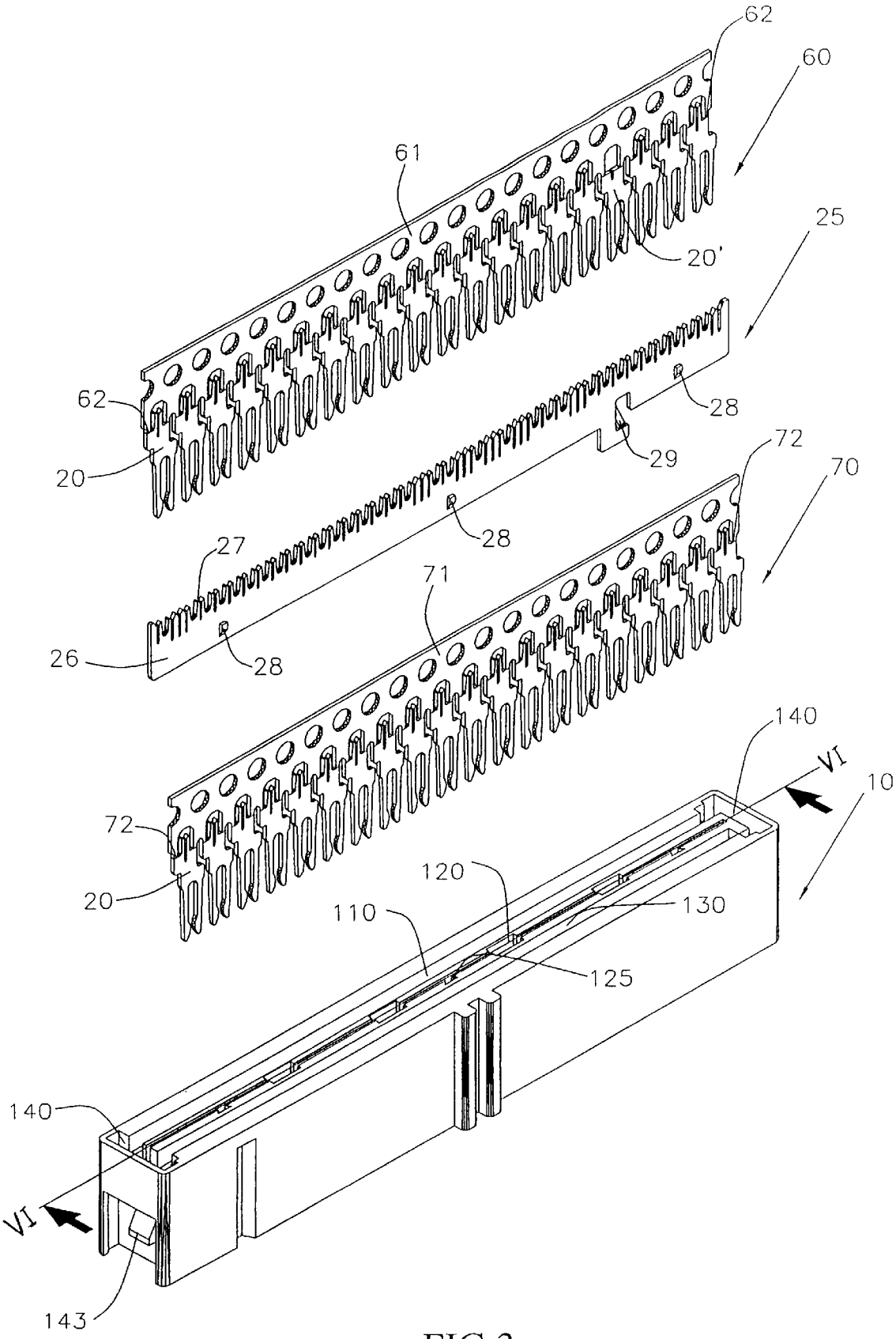
FIG. 3 is an exploded view of the signal terminal piece and the grounding piece of the present invention and the insulating body of the connector.
Figure 4:
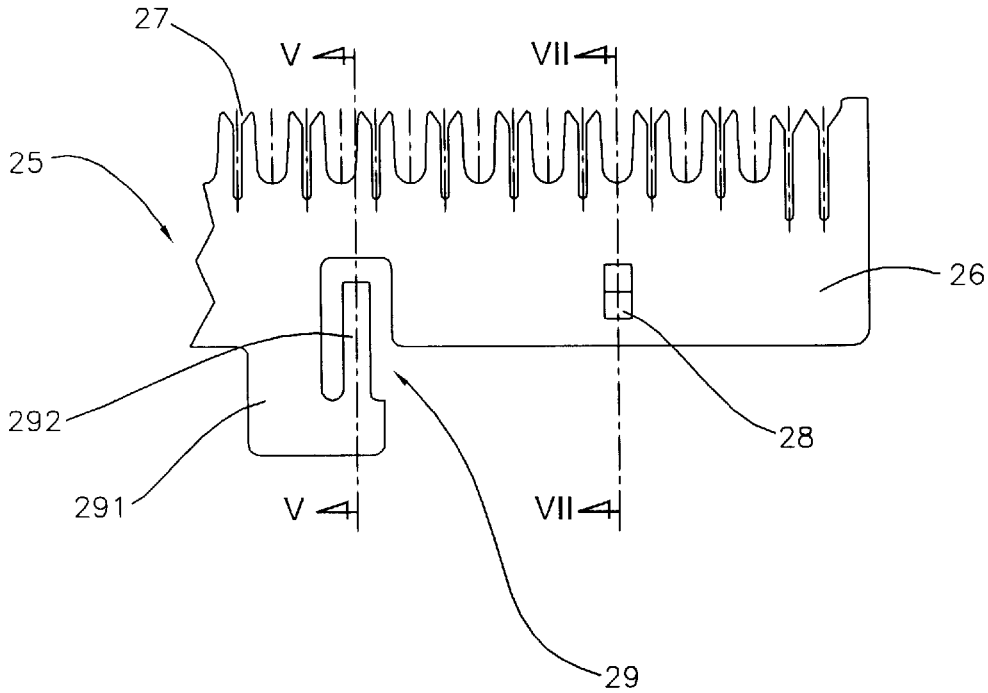
FIG. 4 is a partial enlarged plan view of the grounding piece in the present invention.

With reference to FIG. 3, a schematic view showing the assembly of the signal terminal pieces 60 and 70 and the grounding piece 25 is illustrated. As shown in the figure, the signal terminal pieces 60 and 70 are inserted into the slots 110 and 130 of the insulating body 10. The grounding piece 25 is inserted into the slot 120. The signal terminal pieces 60 and 70 have connecting pieces 61 and 71. A plurality of signal terminals 20 with equal spaces are formed at the lower side of the connecting pieces. The foldable portions 62 and 72 serves to connect the signal terminals 20 and the connecting pieces. Once the signal terminal piece is inserted into the slot, the connecting portion can be broken in the foldable portion 62 and 72 for being removed. Besides, as shown in FIG. 3, the grounding piece 25 includes a base 26. A plurality of grounding terminals 27 are punched at the upper portion of the base 26. The gap of two adjacent terminals 27 are specially designed so that the alternatively arranged signal wires and grounding wires of the flat cable are connected to the signal terminals and grounding terminals, respectively. As shown in FIG. 4, in a specific position of the base of the grounding piece 25, a specific grounding device 29 are punched further. It should be appreciated that the word 'specific' herein means that it is designed for the special specification of some signal. Namely, for the signal, the first connector is grounded, and after grounding, it will not be connected to the second connector and third connector. The detail about the structure and function of the specific grounding device 29 will be described hereinafter.

Figure 5:
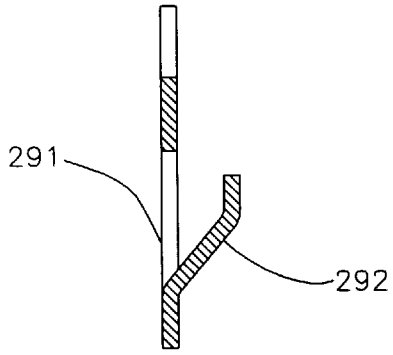
FIG. 5 is a cross-sectional view along the line V—V of FIG. 4, wherein the structure of the specific grounding device in the present invention is illustrated.
Figure 6:
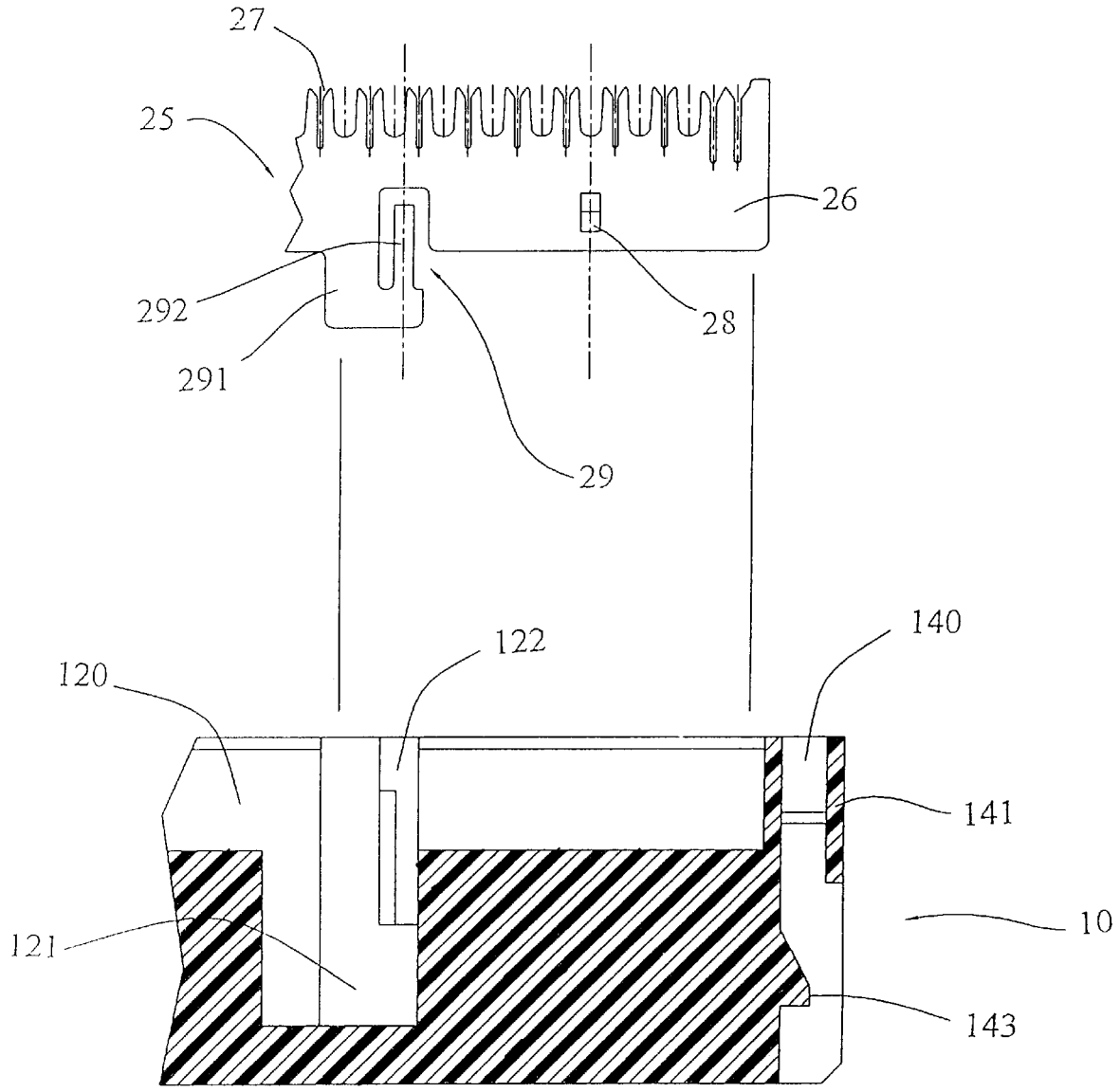
FIG. 6 is a partial, exploded, cross-sectional view of the grounding piece along line VI—VI of FIG. 3, wherein the relation between the grounding piece and the slots are illustrated.
Figure 9:
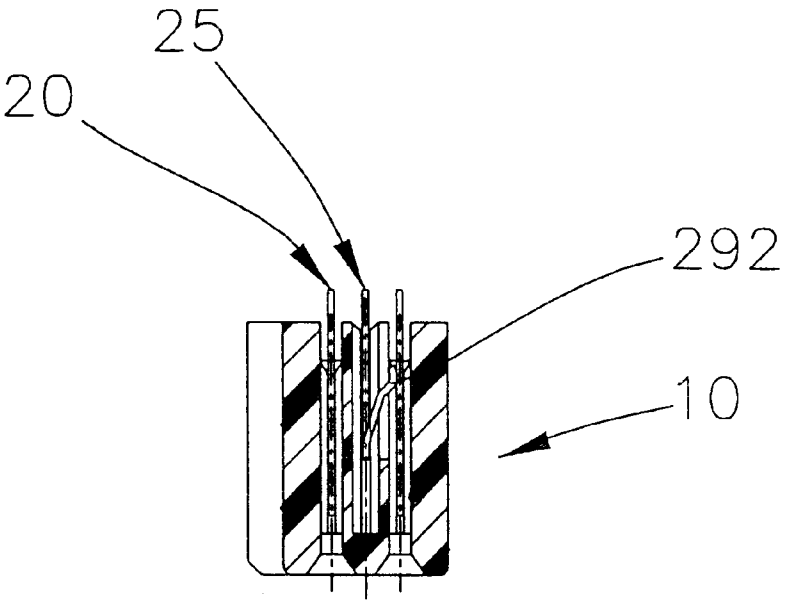
FIG. 9 is a cross-sectional view taken along line IX—IX in FIG. 8.
Figure 8:
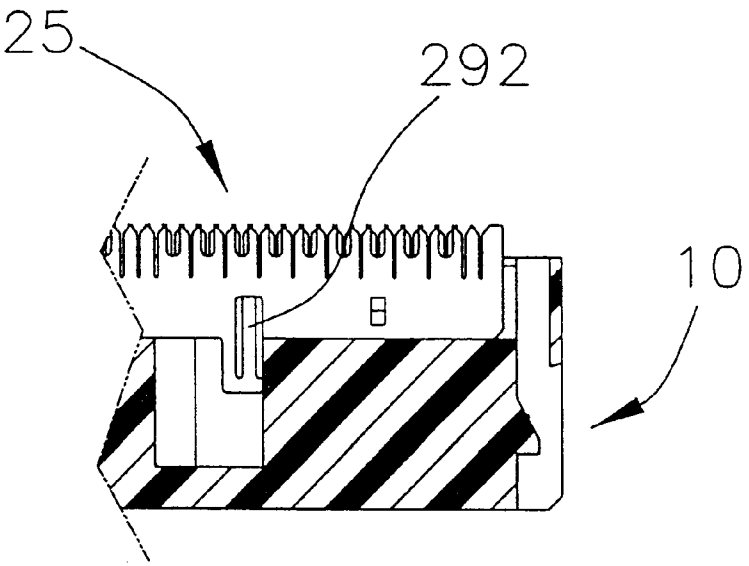
FIG. 8 is a partial, cross-sectional view showing the assembly of the grounding piece and the insulating body.

With reference to FIGS. 4 and 5, a partial enlarged view of the grounding piece 25 and a cross-sectional view of the specific grounding device 29 are illustrated. As shown in the figure, the specific grounding device 29 includes a mounting arm 291 and an elastic contact arm 292. The elastic contact arm 292 protrudes from the plane of the base 26 with an angle. As shown in FIG. 6, when the grounding piece 25 is inserted into the slot 120 of the insulating body 10, the mounting arm 291 of the specific grounding device 29 will be embedded into the mounting hole 121 within the slot 120. Since the spacing wall of the grounding piece slot 120 and the signal terminal slot 110 are hollowed, the elastic contact arm 292 of the specific grounding device 29 protrudes through the hollow portion 122 to be in contact with the specific signal terminal 20' in the adjacent slot 110 (referring to FIG. 3). By this design, the signal transferred from an active device, for example, a motherboard, can directly contact with the specific signal terminal 20' through the specific grounding device 29 of the grounding piece 25 for achieving the object of grounding without needing the extra grounding terminals from the specific signal terminals connected to the flange 25 as in the prior art flat cable 50.

Those skilled in the art should understand that by the design of the specific grounding device 29 of the grounding piece 25 according to the present invention, the grounding for some specific signal can be achieved by the contact between a specific grounding device 29 and a specific signal terminal 20'. Therefore, the signal wire with respect to a specific signal in the flat cable 50 is unnecessary to be connected to the specific signal terminal 20' in the first connector 1. Therefore, a shown in FIG. 3, the contact portion of the specific signal terminal 20' is cut. It is performed in the process that a signal terminal piece 60 with a specific length is cut from a continuous strip. Therefore, when the signal terminal piece 60 is made for the first connector, it is unnecessary to cut the contact portion of a specific signal terminal 20'.

It should be emphasized that the cutting operation of the contact portion in the specific signal terminal 20' is performed from the first connector 1. The contact portions of the signal terminals of the second connector 2 and the third connector 3 with respect to the specific signal terminal are not cut. Thus, the signals in the second connector 2 and the third connector 3 are transferred by specific signal wire with respect to the flat cable 50. Moreover, since the specific signal wire is not connected to the signal terminal of the first connector, the signal wire will not conduct to the first connector but conduct with the second connector and third connector. In the prior alt, in order that an insulation is formed between the first connector and the second and third connectors, a notch is installed in the specific signal wire of the flat cable. However, by the present invention, no notch is necessary to be formed in the specific signal wire. As a result, the process of the cable assembly is greatly reduced and the cost is also decreased.

Besides, according to the present invention, some specific signal is grounded by contacting the specific grounding device of the grounding piece with the specific signal terminal directly instead of using an extra grounding terminal in the flat cable and the grounding piece as in the prior art. Therefore, no grounding terminal is necessary to be installed for the grounding of a specific signal. Thus, all the grounding pieces of the connectors in the cable assembly are identical. No mold is necessary to be developed for different grounding pieces.

Figure 7:
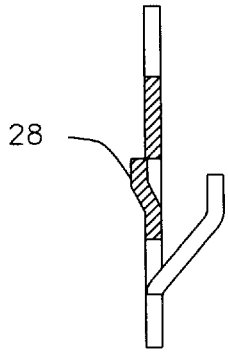
FIG. 7 is a cross-sectional view along the cross-sectional line VII—VII of FIG. 4.

Moreover, as shown in FIG. 3, in order that the grounding piece can be precisely positioned, the grounding piece slot 120 of the insulating body 10, elastic positioning arms 28 are punched at the three spaced positions of the base 26 of the grounding piece 25. As shown in FIG. 7, the elastic positioning arm 28 protrudes from the plane of the grounding piece base 26 at an angle. As shown in FIG. 3, in a position in the inner wall of the grounding piece slot 120 with respect to the elastic positioning arm 28 of the grounding piece, three trenches 125 are formed, so that when the grounding piece 25 is inserted into the slot 120, the elastic positioning arm 28 of the grounding piece 25 can resist against the trenches 125 at the inner wall of the slot 120 for guiding the grounding piece 25. Furthermore, the grounding piece 25 may be positioned in the slot 120 precisely.

Although the present invention has been described with reference to the preferred embodiments, it will be understood that the invention is not limited to the details described thereof. Various substitutions and modifications have been suggested in the foregoing description, and others will occur to those of ordinary skill in the art. Therefore, all such substitutions and modifications are intended to be embraced within the scope of the invention as defined in the appended claims. For example, the number of the specific grounding device and the specific signal terminal can be more than one. The number of the connectors in the cable assembly is not confined to be three, it can be larger or smaller than three. All such modifications and variations are within the scope and spirit of the present invention.

What is claimed is:

1. A flat cable and connector assembly comprising:

a) a flat cable having a plurality of parallel conductors;

b) a first connector attached to the flat cable and comprising:

i) a first elongated insulating body having two outer slots and a central slot therein, the central slot having a plurality of recesses on a side thereof;

ii) a plurality of first signal terminals located in each of the two outer slots, all of the signal terminals in a first of the two outer slots in contact with the plurality of parallel conductors of the flat cable and at least one of the signal terminals in a second of the two outer slots being out of contact with at least one predetermined conductor of the flat cable; and, iii) a first grounding member located in the central slot, the first grounding member having a plurality of grounding terminals extending from a base; a plurality of positioning arms extending laterally from the base, each engaging one of the plurality of recesses; at least one mounting arm extending from the base and having an elastic contact arm extending therefrom, the contact arm contacting the at least one signal terminal that is not in contact with the at least one predetermined conductor;

c) second and third connectors attached to the flat cable, comprising:

i) second and third elongated bodies identical to the first elongated body of the first connector;

ii) a plurality of second and third signal terminals located in the second and third elongated bodies, the second and third signal terminals all being in contact with the electrical conductors of the flat cable; and, iii) second and third grounding members located in the second and third elongated bodies;

d) a first positioning cover attached to each of the elongated insulating bodies such that the flat cable is located between the first positioning cover and the associated elongated positioning body; and, e) a second positioning cover located on each of the first positioning covers and attached to the respective elongated insulating body.

2. The flat cable and connector assembly of claim 1 further comprising:

a) an outer wall on two opposite ends of each elongated insulating body, each outer wall and the associated elongated insulating body bounding a through hole;

b) a buckling flange located in each through hole;

c) a buckling arm extending from each of two opposite ends of each first positioning cover, each buckling arm passing into one of the through holes and engaging with the associated buckling flange, each buckling arm having a hollow portion; and, d) a hook arm extending from each of two opposite ends of each second positioning cover and having a hook portion, each hook arm extending into one of the hollow portions such that the hook portion engages one of the outer walls.

3. The flat cable and connector assembly of claim 1 wherein the plurality of positioning arms and the elastic contact arm extend laterally from opposite sides of the first grounding member.

* * * * *